US008803633B2

(12) United States Patent
Tokuda et al.

(10) Patent No.: US 8,803,633 B2
(45) Date of Patent: Aug. 12, 2014

(54) DIRECTIONAL COUPLER

(71) Applicant: Murata Manufacturing Co., Ltd., Kyoto (JP)

(72) Inventors: Daisuke Tokuda, Kyoto (JP); Kazutaka Mukaiyama, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 13/891,075

(22) Filed: May 9, 2013

(65) Prior Publication Data

US 2013/0241668 A1 Sep. 19, 2013

Related U.S. Application Data

(63) Continuation of application No. PCT/JP2011/075895, filed on Nov. 10, 2011.

(30) Foreign Application Priority Data

Nov. 12, 2010 (JP) ..... 2010-253854

(51) Int. Cl.
*H01P 5/12* (2006.01)
*H01P 3/08* (2006.01)

(52) U.S. Cl.
USPC ..... 333/109; 333/116

(58) Field of Classification Search
USPC ..... 333/109, 110, 111, 112, 116
See application file for complete search history.

(56) References Cited

U.S. PATENT DOCUMENTS

| | | | | |
|---|---|---|---|---|
| 4,795,989 | A | 1/1989 | Hart et al. | |
| 5,446,425 | A | 8/1995 | Banba | |
| 7,327,582 | B2 | 2/2008 | Casper et al. | |
| 8,421,553 | B2 | 4/2013 | Mukaiyama | |
| 2010/0001810 | A1 * | 1/2010 | Charley et al. | 333/109 |
| 2010/0171564 | A1 | 7/2010 | Yamamoto et al. | |
| 2010/0194489 | A1 * | 8/2010 | Kearns et al. | 333/116 |

FOREIGN PATENT DOCUMENTS

| | | | |
|---|---|---|---|
| CN | 201509200 | U | 6/2010 |
| JP | 2651336 | B2 | 9/1997 |
| JP | 2002-223135 | A | 8/2002 |
| JP | 2007-194870 | A | 8/2007 |
| JP | 2010-161466 | A | 7/2010 |
| WO | 2011/102187 | A1 | 8/2011 |

OTHER PUBLICATIONS

International Search Report; PCT/JP2011/075895; Feb. 14, 2012.
Written Opinion of the International Searching Authority; PCT/JP2011/075895; Feb. 14, 2012.

(Continued)

*Primary Examiner* — Dean O Takaoka
(74) *Attorney, Agent, or Firm* — Studebaker & Brackett PC

(57) ABSTRACT

In a directional coupler, even when parasitic inductance exists, an increase in device size can be suppressed while obtaining good isolation characteristics. A transmission line type directional coupler includes a main line and a sub line that is coupled to the main line through electric field coupling and magnetic field coupling. The main line includes a signal input port and a signal output port, and the sub line includes a coupling port and an isolation port. A series capacitor is connected to only one of the signal output port and the coupling port.

10 Claims, 12 Drawing Sheets

(56) References Cited

OTHER PUBLICATIONS

R. Phromloungsri et al.; "Inductively Compensated Parallel Coupled Microstrip Lines and Their Applications"; IEEE Transactions on Microwave Theorgy and Techniques, Vo. 54, No. 9, Sep. 2006, pp. 3571-3582.

An Office Action issued by the Korean Patent Office on Mar. 25, 2014, which corresponds to Korean Patent Application No. 10-2013-7011119 and is related to U.S. Appl. No. 13/891,075; with English language concise explanation of relevance.

R. K. Hoffmann; "Handbook of Microwave Integrated Circuits"; The Artech House Microwave Library; ISBN 0-89006-163-7; 1987, Extracted pp. 4, 5, 14, 15, 24, 25, 66, 67, 92, and 93; Chapter 1.

The first Office Action issued by the Chinese Patent Office on Apr. 14, 2014, which corresponds to Chinese Patent Application No. 201180054132.7 and is related to U.S. Appl. No. 131891,075; with English language translation.

* cited by examiner (A)

FIG. 6

| CIRCUIT CONFIGURATION | INSERTION LOSS [dB] | AMOUNT OF COUPLING [dB] | ISOLATION [dB] | DIR [dB] | SIZE |
|---|---|---|---|---|---|
| DIRECTIONAL COUPLER 20A | 0.06 | 20 | 61 | 41 | MIDDLE |
| DIRECTIONAL COUPLER 120A | 0.04 | 20 | 86 | 66 | SMALL |
| DIRECTIONAL COUPLER 120B | 0.06 | 20 | 34 | 14 | SMALL |
| DIRECTIONAL COUPLER 120C | 0.06 | 20 | 73 | 53 | TOO LARGE |

DIRECTIONAL COUPLER

CROSS REFERENCE TO RELATED APPLICATIONS

The present application is a continuation of International Application No. PCT/JP2011/075895 filed on Nov. 10, 2011, and claims priority to Japanese Patent Application No. 2010-253854 filed on Nov. 12, 2010, the entire contents of each of these applications being incorporated herein by reference in their entirety.

TECHNICAL FIELD

The technical field relates to directional couplers, and specifically relates to improvement of the characteristics of transmission line type directional couplers.

BACKGROUND

To date, directional couplers have been used for, for example, measurement of high-frequency signals. See, for example, Japanese Unexamined Patent Application Publication No. 2009-044303 (Patent Document 1).

FIG. 1(A) is a block diagram of an RF transmission circuit 100 used in, for example, cellular phones. The RF transmission circuit 100 includes an antenna 111, a directional coupler 120A, a transmission power amplifier 113, a modulation circuit 112, and an automatic gain control circuit 114. The directional coupler 120A, which is of a transmission line type, includes a main line 121 and a coupling line (sub line) 122. The main line 121 is connected between the antenna 111 and the transmission power amplifier 113. The automatic gain control circuit 114 is connected to the directional coupler 120A and the sub line 122, and controls the transmission power amplifier 113 on the basis of a signal from the sub line 122 which is coupled to the main line 121.

FIG. 1(B) is an equivalent circuit diagram of the directional coupler 120A. Here, the directional coupler 120A is assumed to be an ideal circuit, in which the coupling factor of a mutual inductance M between the main line 121 and the sub line 122 is 1. The main line 121 has a signal input port RFin and a signal output port RFout, and the sub line 122 has a coupling port CPL and an isolation port ISO. The main line 121 and the sub line 122 are coupled to each other through electric field coupling due to distributed capacitances C between the two lines, and at the same time coupled to each other through magnetic field coupling due to the mutual inductance M.

When a signal S1 is input from the signal input port RFin in the main line 121, a signal S2 propagates toward the coupling port CPL and a signal S3 propagates toward the isolation port ISO, in the sub line 122, due to electric field coupling caused by coupling capacitances C. A signal S4 and a signal S5 propagate in a direction from the isolation port ISO to the coupling port CPL in a closed loop formed of the sub line 122 and the ground (GND), due to magnetic field coupling caused by the mutual inductance M.

In this ideal equivalent circuit, the signal S2 and the signal S4 that flow to the coupling port CPL both have a phase of +90° with respect to the signal S1, i.e., the same phase. Hence, a signal having a power which is the sum of the power of the signal S2 and the power of the signal S4 is output from the coupling port CPL. On the other hand, regarding the signals S3 and S5 that flow to and from the isolation port ISO, the signal S3 has a phase of +90° with respect to the signal S1, and the signal S5 has a phase of −90° with respect to the signal S1, that is, the signal S3 and the signal S5 have opposite phases.

Hence, the power of the signal S3 and the power of the signal S5 cancel each other out, whereby no signals are output.

FIGS. 2(A) and 2(B) are diagrams illustrating the frequency characteristics and isolation characteristics of the directional coupler 120A. Referring to the frequency characteristics illustrated in FIG. 2(A), the insertion loss is approximately zero over the whole frequency range, and the amount of isolation of the isolation port ISO is extremely small compared with the amount of coupling of the coupling port CPL. Hence, a high directivity is obtained. The isolation characteristics illustrated in FIG. 2(B) illustrate, using polar coordinates, a signal output from the isolation port ISO, which is always approximately zero irrespective of the frequency.

SUMMARY

The present disclosure provides a directional coupler having a configuration in which, even when a parasitic inductance exists, good isolation characteristics are obtained and an increase in the size of the directional coupler is suppressed.

In an embodiment, a directional coupler includes a main line and a sub line that is coupled to the main line through electric field coupling and magnetic field coupling. The main line includes a signal input port and a signal output port, and the sub line includes a coupling port and an isolation port. A series capacitor is connected to only one of the signal output port and the coupling port.

In a more specific embodiment, for a capacitance C1 that resonates with a parasitic inductance of the signal output port at a desired frequency and for a capacitance C2 that resonates with a parasitic inductance of the coupling port at the desired frequency, a capacitance of the series capacitor may be set smaller than or equal to the capacitance C1 or smaller than or equal to the capacitance C2.

In another more specific embodiment, the capacitance of the series capacitor may be set to a capacitance Cx that satisfies the following equation:

$$Cx=1/(1/C1+1/C2). \quad [h1]$$

In yet another more specific embodiment, the series capacitor may be connected to only the coupling port among the signal output port and the coupling port. With this configuration, since the series capacitor is not connected to the signal output port, an increase in insertion loss can be prevented.

In still another more specific embodiment, the main line, the sub line, and electrode patterns of the series capacitor are preferably formed using a thin-film process.

In another more specific embodiment, at least one of the main line and the sub line may be used as an electrode for composing the series capacitor.

In another more specific embodiment, a semi-insulating substrate may be used.

BRIEF DESCRIPTION OF DRAWINGS

FIG. 6 illustrates comparisons of a configuration in the present disclosure with existing configurations in terms of frequency characteristics.

DETAILED DESCRIPTION

In the ideal directional coupler 120A described above, the coupling factor of the mutual inductance M is 1, and a signal generated through electric field coupling and a signal generated through magnetic field coupling have opposite phases and cancel each other out at the isolation port ISO. However, in an actual directional coupler, it is difficult to make the coupling factor of the mutual inductance M be 1 as described above, and usually there exists parasitic inductance generated due to routing lines or wiring lines.

Figure 1:
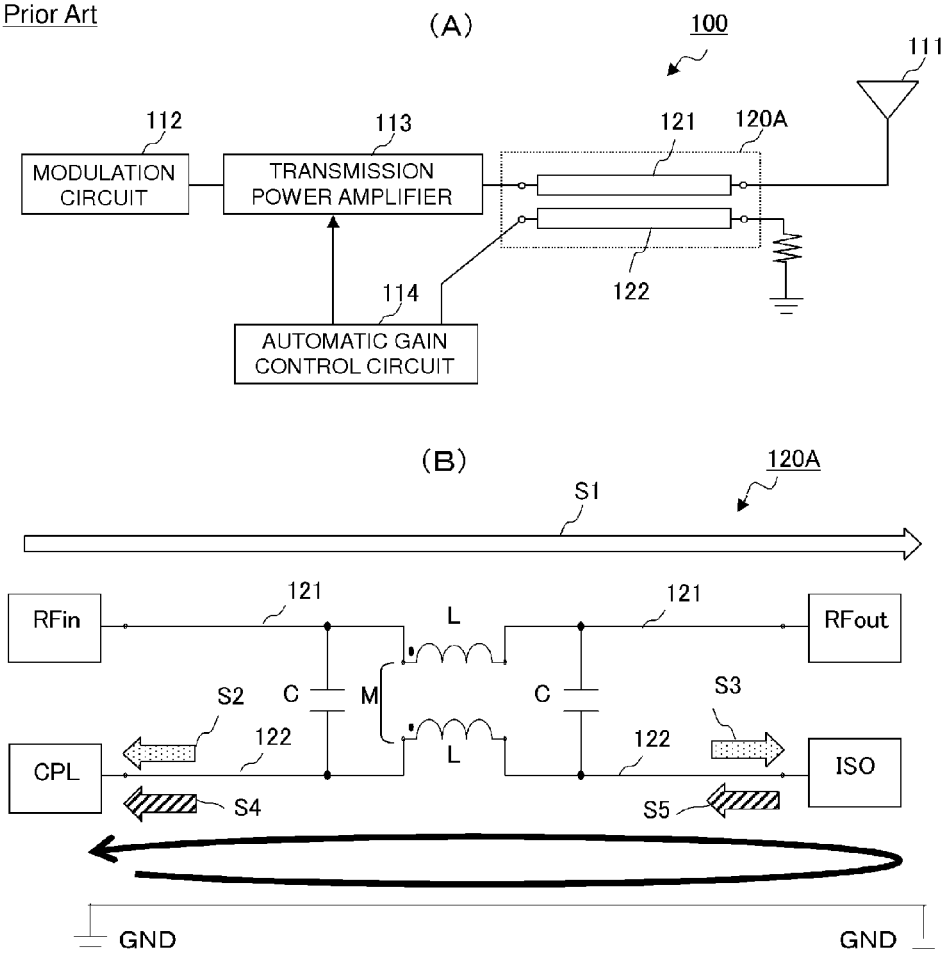
FIG. 1 Prior Art
FIG. 1 is a diagram illustrating a transmission line type directional coupler provided in an RF transmission circuit.
Figure 2:
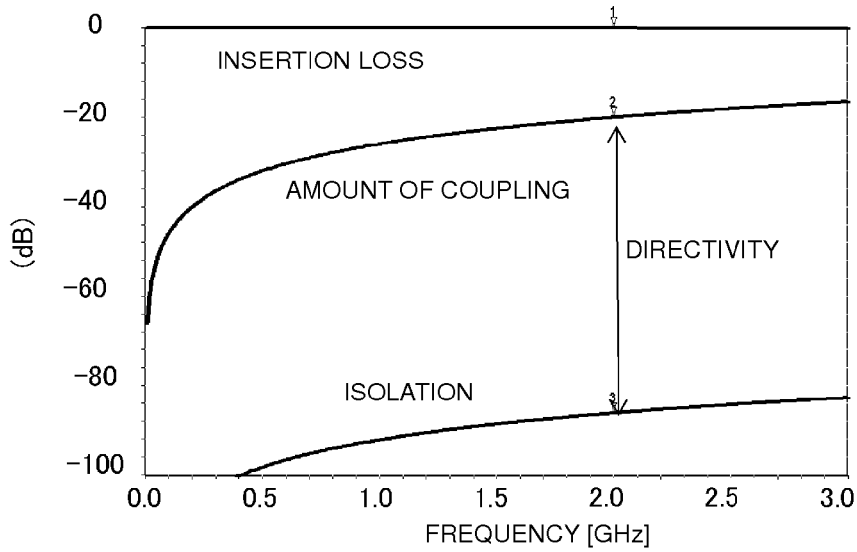
FIG. 2 Prior Art
FIG. 2 is a diagram illustrating the frequency characteristics and isolation characteristics of the directional coupler illustrated in FIG. 1.
Figure 2:
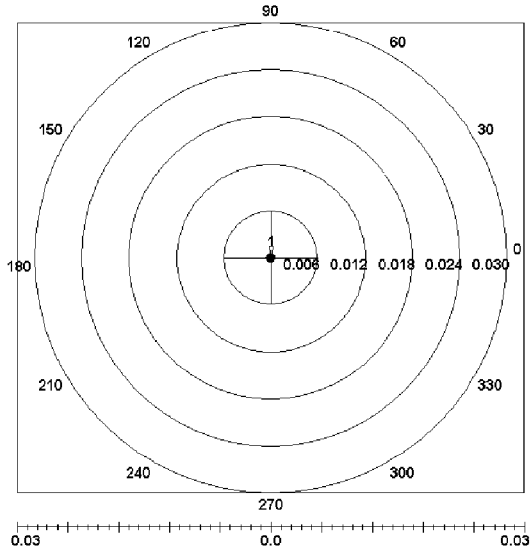
FIG. 2 Prior Art
Figure 3:
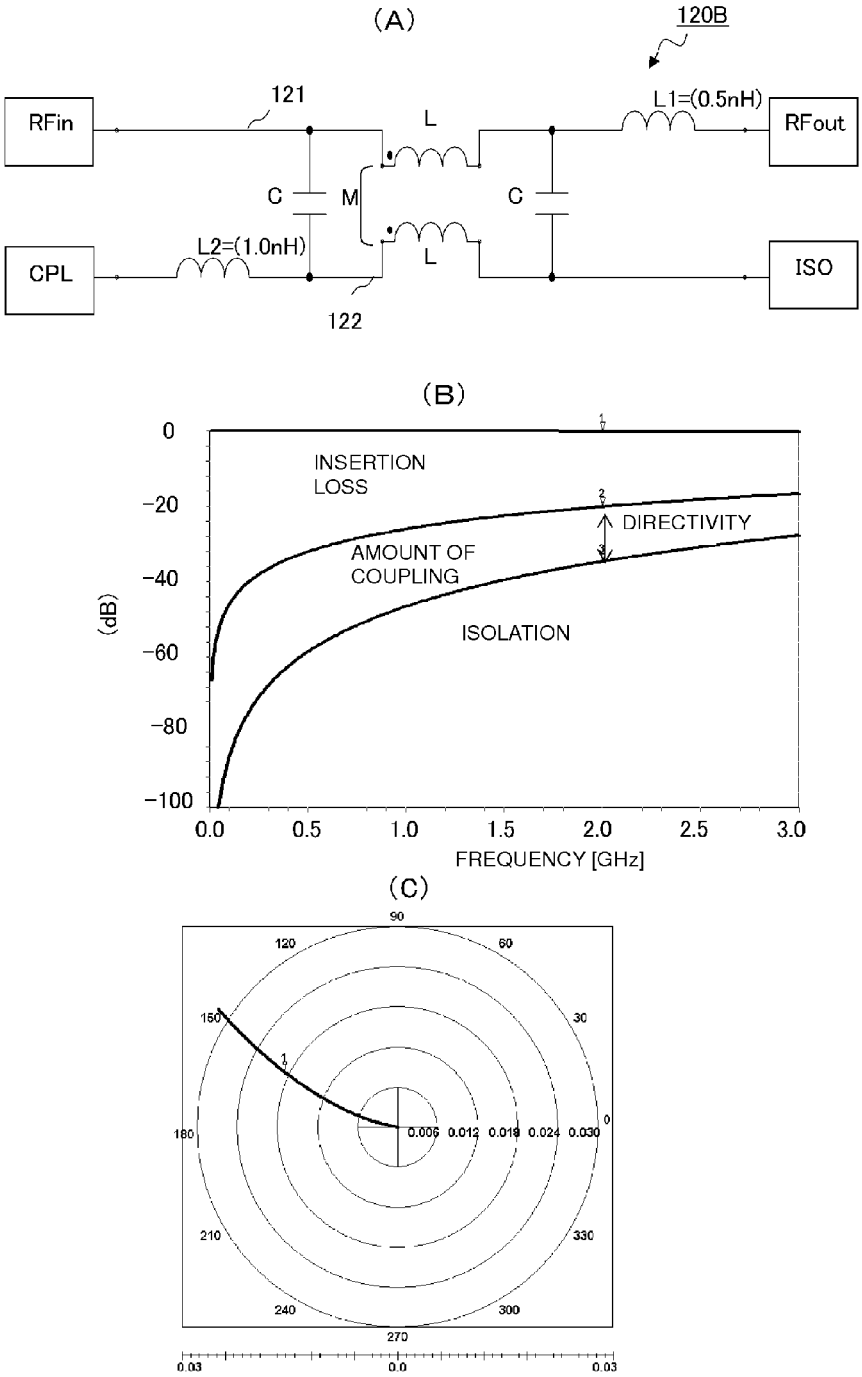
FIG. 3 is a diagram illustrating an influence from a parasitic inductance in a transmission line type directional coupler.

FIGS. 3(A) and 3(B) are diagrams illustrating an influence from parasitic inductance in an actual directional coupler 120B. FIG. 3(A) illustrates the equivalent circuit of the directional coupler 120B. In the directional coupler 120B, a parasitic inductance L1 is generated at the signal output port RFout of the main line 121, and a parasitic inductance L2 is generated at the coupling port CPL of the sub line 122. FIG. 3(B) and FIG. 3(C) respectively illustrate the frequency characteristics and isolation characteristics of the directional coupler 120B for the case in which the parasitic inductance L1=0.5 nH and the parasitic inductance L2=1.0 nH. In this case, phase delays are generated in a signal generated through electric field coupling and a signal generated through magnetic field coupling in the sub line 122, whereby a signal that cannot be cancelled out by the sum of the two signals is generated in the isolation port ISO. As a result, sufficient isolation and directivity are not ensured. Note that parasitic inductances may be generated also at the signal input port RFin and the isolation port ISO, but these inductances seldom degrade the isolation characteristics and directivity of the directional coupler, and hence it is assumed here that these inductances are not generated.

Connecting a series capacitor in series with a parasitic inductance is a known technique to suppress an influence from parasitic inductance in a high-frequency circuit. Hence, series capacitors may be connected in series with the parasitic inductances L1 and L2, also in the case of the directional coupler 120B.

Figure 4:
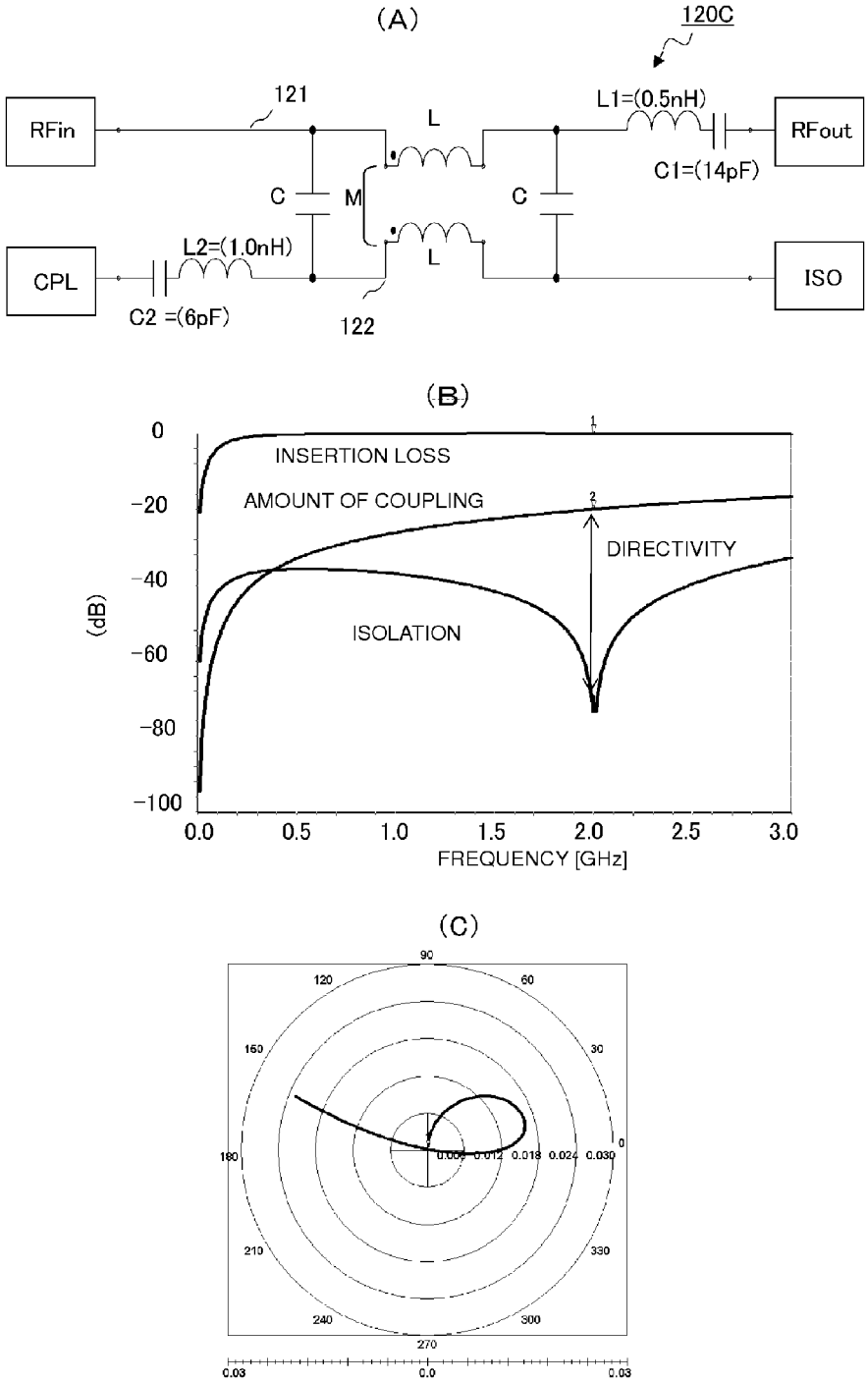
FIG. 4 is a diagram illustrating an influence from a series capacitance that resonates with a parasitic inductance in a transmission line type directional coupler.

FIG. 4 is a diagram illustrating a directional coupler 120C having a configuration in which series capacitors are connected in series with parasitic inductances. In the directional coupler 120C, a series capacitor C1 having a capacitance C1 (=14 pF) that resonates in a series resonance mode with the inductance L1 (=0.5 nH) at a desired frequency (approximately 2.0 GHz) is inserted into the main line 121, and a series capacitor C2 having a capacitance C2 (=6 pF) that resonates in a series resonance mode with the inductance L2 (=1.0 nH) at the desired frequency (approximately 2.0 GHz) is inserted into the sub line 122. In this case, the isolation and directivity are improved at the frequency (approximately 2.0 GHz) at which the parasitic inductances and the series capacitors resonate in a series resonance mode.

However, the inventors realized that with such a circuit configuration in which series capacitors are inserted, the device size of the whole directional coupler 120C is increased by the sizes of the series capacitors C1 and C2. In particular, from the view point of impedance matching with an external circuit at the signal output port RFout, the circuit needs to be designed in such a manner that the parasitic inductance L1 at the signal output port RFout is small and, in this case, the series capacitor C1 that resonates with the parasitic inductance L1 in a series resonance mode becomes extremely large. Hence, the device size is increased due to the series capacitor C1.

Hereinafter, the general configuration and operation of a transmission line type directional coupler according to an exemplary embodiment will now be described.

Figure 5:
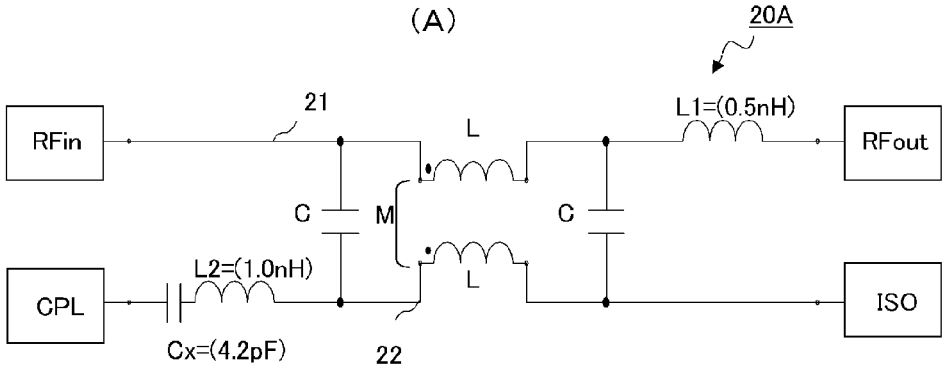
FIG. 5 is a diagram illustrating a directional coupler according to a first exemplary embodiment.
Figure 5:
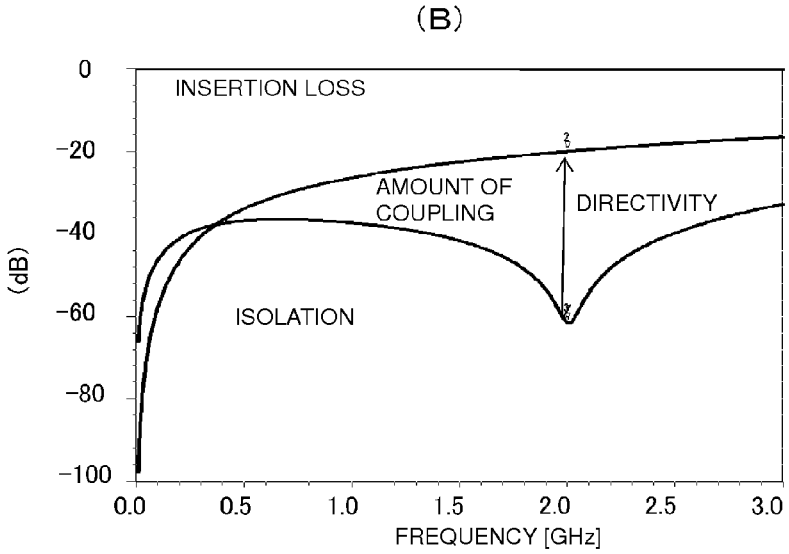
Figure 5:
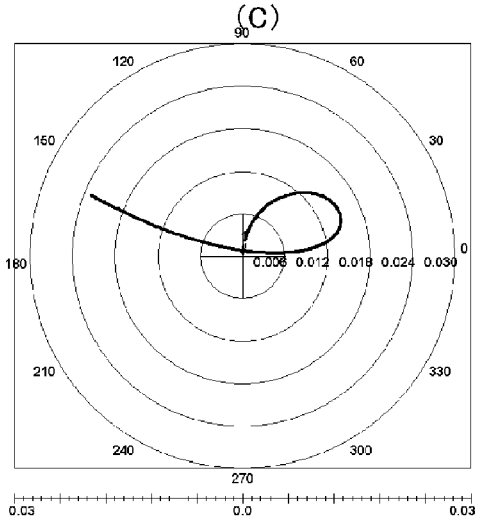

FIG. 5(A) is an equivalent circuit of a transmission line type directional coupler 20A according to a first exemplary embodiment of the present disclosure.

The directional coupler 20A includes a main line 21 and a sub line 22. The main line 21 and the sub line 22 have respective inductances L, and are capacitively coupled to each other due to distributed capacitances C between the lines and coupled to each other through magnetic field coupling due to a mutual inductance M. The main line 21 has a signal input port RFin and a signal output port RFout. The sub line 22 has a coupling port CPL and an isolation port ISO. In the sub line 22, a signal due to electric field coupling and a signal due to magnetic field coupling have the same phase and strengthen each other at the coupling port CPL, and a signal due to electric field coupling and a signal due to magnetic field coupling have opposite phases and weaken each other at the isolation port ISO.

In the case of ideal directional coupling, by appropriately adjusting the mutual inductance M and the distributed capacitances C, the output of the coupling port CPL has only a +90° phase component with respect to the input power of the signal input port RFin. Further, the output of the isolation port ISO becomes approximately zero. However, the coupling factor of the mutual inductance M is not actually 1, and in the main line 21, there exists a parasitic inductance L1 due to the wiring and the like as well as the inductance L of the main line 21 itself. In the sub line 22, there exists a parasitic inductance L2 as well as the inductance of the inductance L of the sub line 22 itself.

As a result, a phase delay caused by a parasitic inductance is generated between the signal due to magnetic field coupling and the signal due to electric field coupling generated in the sub line 22. Hence the output powers due to electric field coupling and magnetic field coupling cannot be completely cancelled out at the isolation port ISO, causing degradation of the isolation characteristics.

Hence, in the present embodiment, a series capacitor Cx is inserted in series with the parasitic inductance L2 in the sub line 22. Here, the series capacitance Cx is made to be a capacitance which is obtained by connecting the series capacitor C1 in series with the series capacitor C2 provided in the directional coupler 120C described before (refer to FIG. 4). In other words, the series capacitance Cx satisfies the following equation. Note that the series capacitances C1 and C2 are capacitances respectively resonating with the parasitic inductances L1 and L2.

$$Cx=1/(1/C1+1/C2)\{=1/(1/14+1/6)=4.2\}$$

As a result, in the directional coupler 20A, the isolation and directivity at a desired frequency (approximately 2.0 GHz)

are improved even though the parasitic inductances L1 and L2 exist. FIG. 5(B) is a diagram illustrating the frequency characteristics of the directional coupler 20A, and FIG. 5(C) is a diagram illustrating the isolation characteristics using polar coordinates. In the frequency characteristics of the directional coupler 20A, the insertion loss at the signal output port RFout is substantially zero over the whole frequency range, and the isolation at the isolation port ISO is considerably improved by resonance at a frequency of approximately 2.0 GHz. At a frequency of approximately 2.0 GHz, the directivity, which is the ratio of the amount of coupling to the amount of the isolation, is also considerably improved.

In this manner, in the directional coupler 20A, the isolation characteristics and directivity can be improved by inserting the series capacitor Cx in series with the coupling port CPL. FIG. 6 illustrates comparisons of the directional coupler 20A with existing configurations in terms of frequency characteristics at a frequency of 2.0 GHz. Compared with the directional coupler 120A having an ideal configuration, the directional coupler 20A exhibits practically usable characteristics, since the isolation and directivity characteristics, although somewhat degraded, are sufficiently above 30 dB, which is a practical lower limit. Compared with the directional coupler 120B, which is unfavorably influenced by a parasitic inductance, the directional coupler 20A exhibits improved isolation and directivity (DIR), and the directivity, in particular, is considerably improved in such a manner as to exceed 30 dB, which is a practical lower limit. Compared with the directional coupler 120C that includes the series capacitors C1 and C2, which resonate with the respective parasitic inductances, an increase in device size is suppressed since only the single series capacitor Cx smaller than the series capacitors C1 and C2 is provided. Further, since the series capacitor Cx has a smaller capacitance and a smaller size than the series capacitors C1 and C2, the directional coupler 20A is suitable for reduction in size also from this viewpoint. Consequently, in the directional coupler 20A in which the series capacitor Cx is connected in series with the coupling port CPL, an increase in device size can be significantly suppressed while avoiding an influence from the parasitic inductance.

Note that in the case where the parasitic inductance L1 is generated only at the signal output port RFout, it is preferable to provide the series capacitor C1 that resonates with the parasitic inductance L1 at the coupling port CPL. In the case where the parasitic inductance L2 is generated only at the coupling port CPL, it is preferable to provide the series capacitor C2 that resonates with the parasitic inductance L2 at the coupling port CPL. The isolation and directivity are improved also in these cases, similarly to the embodiment described above.

Figure 7:
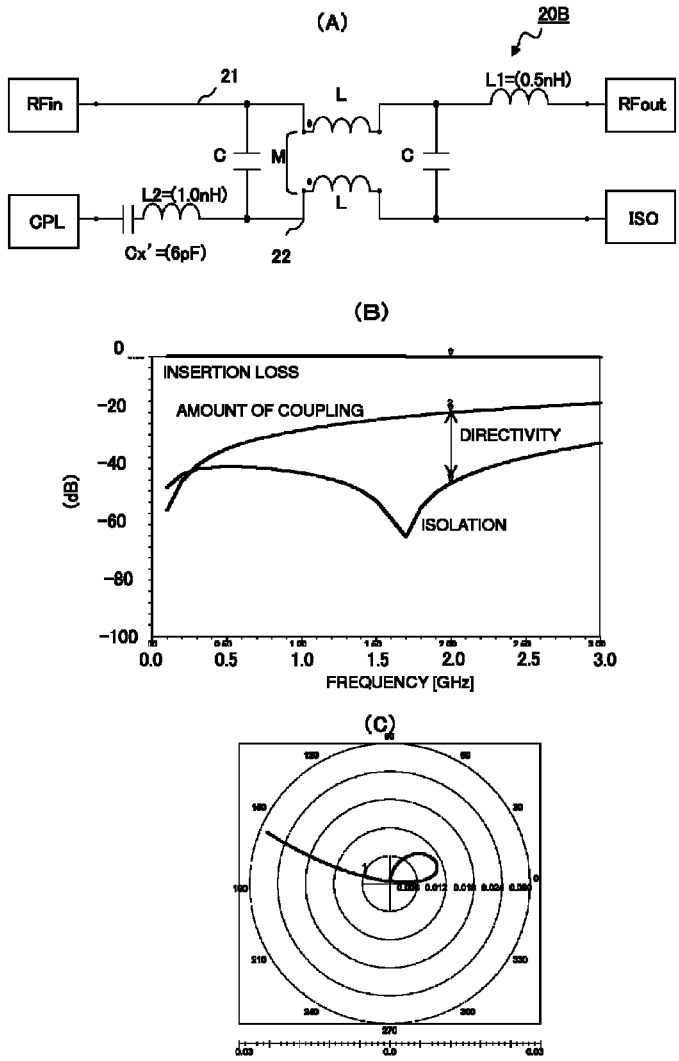
FIG. 7 is a diagram illustrating a directional coupler according to a second exemplary embodiment.

A directional coupler 20B according to a second exemplary embodiment will now be described. FIG. 7(A) is an equivalent circuit diagram of the directional coupler 20B, which has a configuration in which a series capacitor Cx' having a capacitance Cx' (=C2=6 pF) is inserted only at the coupling port CPL.

With this configuration, as illustrated by the frequency characteristics and isolation characteristics of FIGS. 7(B) and 7(C), the resonant frequency resulting from the use of the series capacitor Cx' shifts from a desired frequency (approximately 2.0 GHz). As a result, the effect of improvement in the isolation and directivity is limited and, hence, the isolation and directivity are expected to improve only to some extent. However, since at least the series capacitor C1 provided at the signal output port RFout is omitted, the device size is reduced by the size of the series capacitor C1, and degradation of the insertion loss due to insertion of the series capacitor C1 into the main line 21 is also suppressed. Hence, it is thought to be preferable to connect the capacitor Cx which is equivalent to the series capacitor C1 and the series capacitor C2 connected in series to each other, as in the directional coupler 20A.

Figure 8:
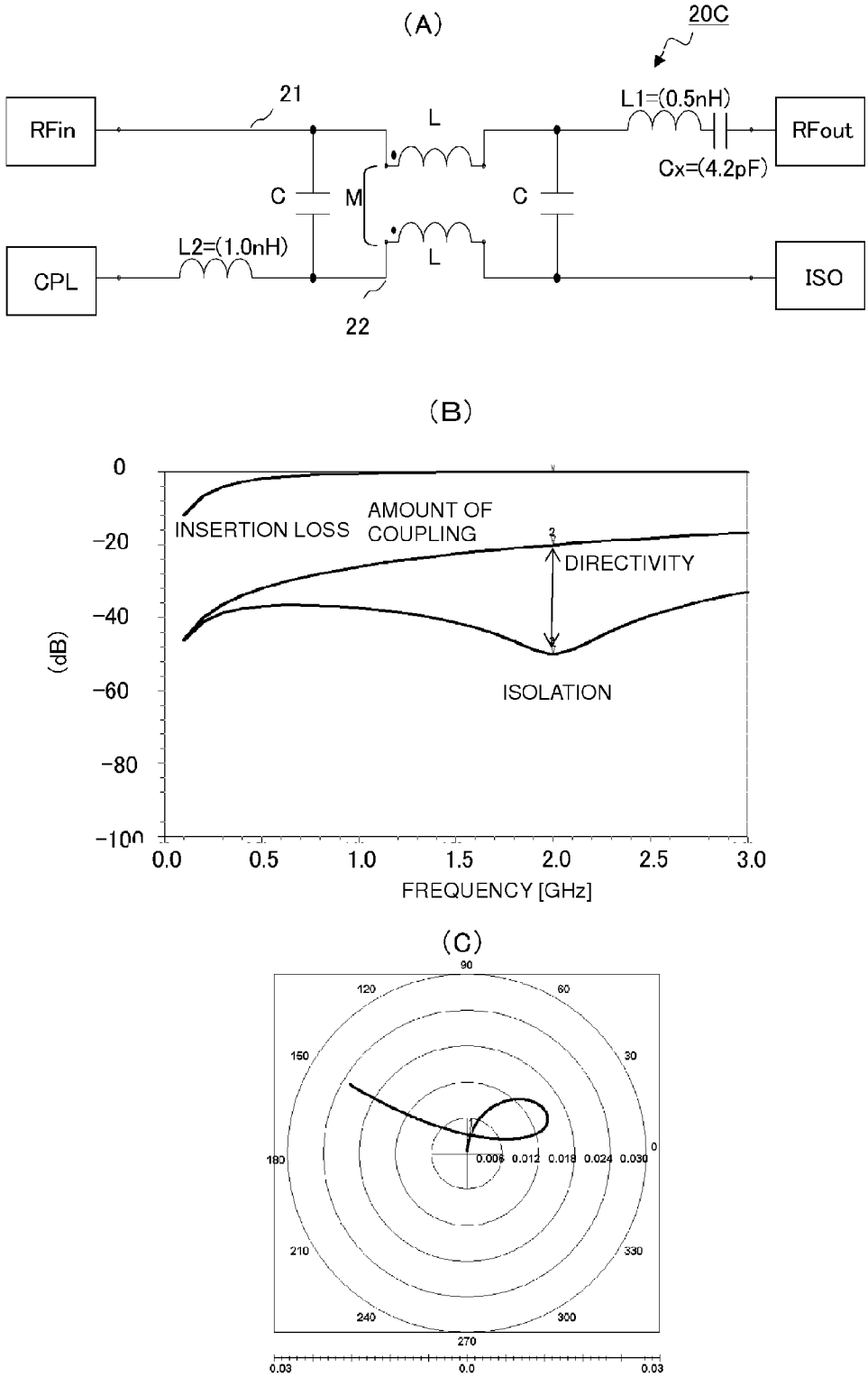
FIG. 8 is a diagram illustrating a directional coupler according to a third exemplary embodiment.

A directional coupler 20C according to a third exemplary embodiment will now be described. FIG. 8(A) is an equivalent circuit diagram of the directional coupler 20C, which has a configuration in which the series capacitor Cx having the capacitance Cx (=4.2 pF) is connected to only the signal output port RFout.

With this configuration, as illustrated by the frequency characteristics and isolation characteristics of FIGS. 8(B) and 8(C), the resonant frequency resulting from the use of the series capacitor Cx is a desired frequency (approximately 2.0 GHz), and improvement in the isolation and directivity to some extent is expected. Further, since at least the series capacitor C2 provided at the coupling port CPL is omitted, the device size is reduced by the size of the series capacitor C2. However, some degradation of the insertion loss is generated due to insertion of the series capacitor Cx into the main line 21. As a result, it is thought to be preferable to connect a series capacitor to the coupling port CPL as in the directional coupler 20A.

Figure 9:
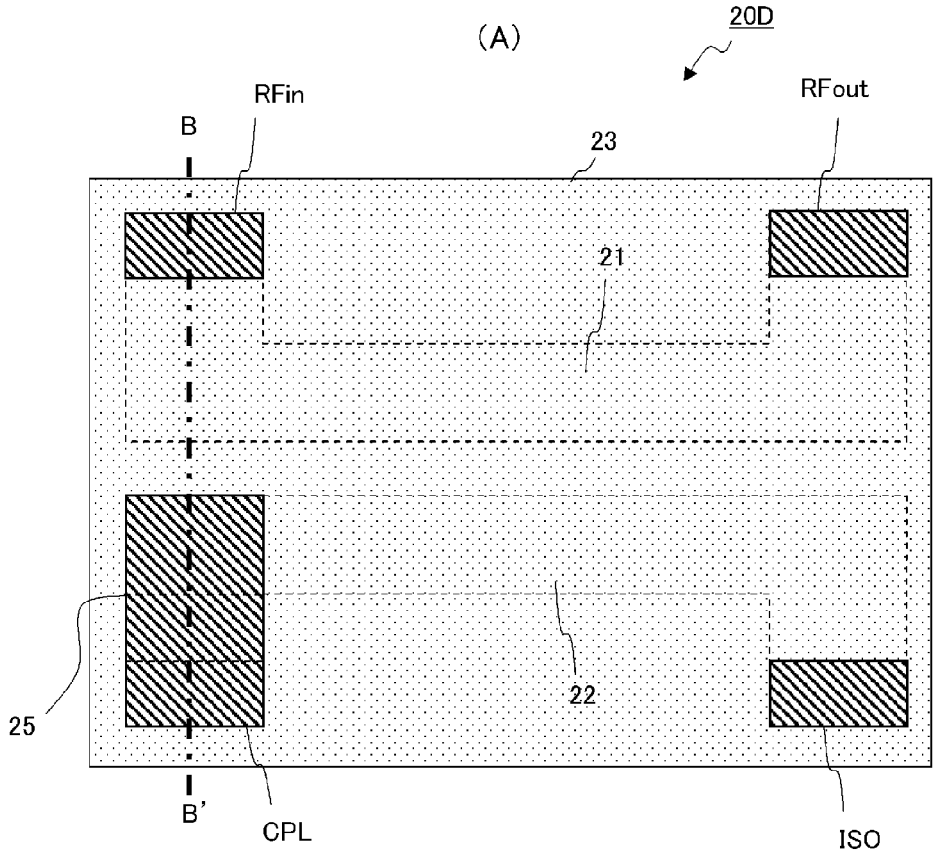
FIG. 9 is a diagram illustrating an example of a directional coupler.
Figure 9:
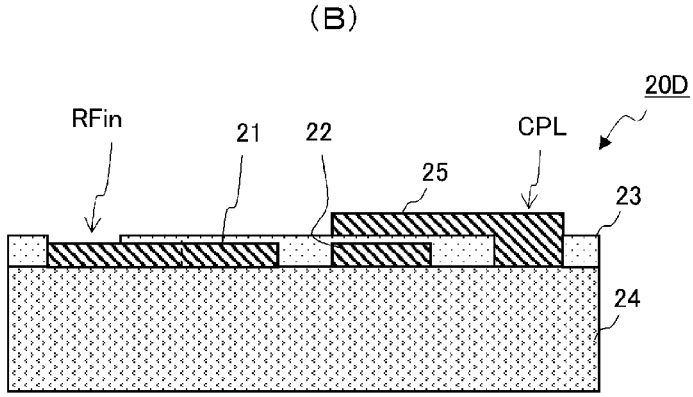

An exemplary method of manufacturing a directional coupler of the present disclosure will now be described. FIG. 9(A) is a pattern diagram of a directional coupler 20D, and FIG. 9(B) illustrates a sectional view taken along line B-B' illustrated in FIG. 9(A).

The directional coupler 20D includes a main line 21, a sub line 22, a signal input port RFin, a signal output port RFout, a coupling port CPL, and an isolation port ISO formed on a semi-insulating substrate 24. A dielectric layer 23 having openings for exposing the ports is stacked on the semi-insulating substrate 24. A top electrode 25 is formed in the opening where the coupling port CPL is exposed and on the dielectric layer 23 in such a manner as to extend from the opening. A series capacitor Cx is formed by making the rectangular area of the end portion of the top electrode 25 overlap the rectangular area of the end portion of the sub line 22. The signal input port RFin, the signal output port RFout, the coupling port CPL, and the isolation port ISO are connected to external circuits using wiring lines or the like.

Figure 10:
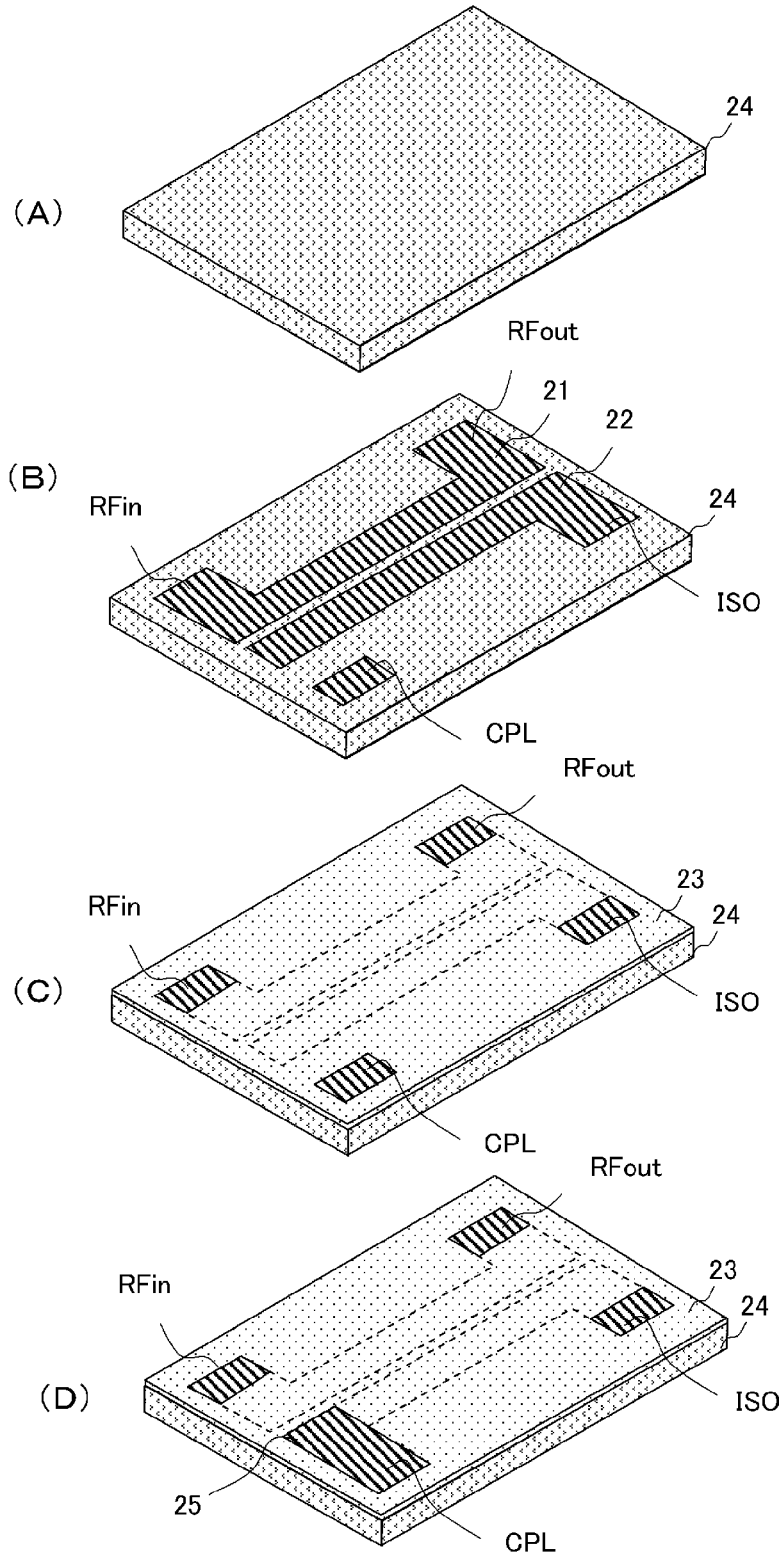
FIG. 10 is a diagram illustrating an example of a thin-film process related to manufacturing a directional coupler.

FIG. 10 is a schematic diagram illustrating the process of manufacturing the directional coupler 20D.

The directional coupler 20D, which allows a plurality of devices to be arranged thereon, is manufactured using a wafer (substrate) made of a material with a low dielectric loss, such as gallium arsenide (GaAs). In the figure, an area of the wafer in which an individual device is formed is illustrated as the semi-insulating substrate 24.

First, as illustrated in FIG. 10(B), the main line 21, the sub line 22, the signal input port RFin, the signal output port RFout, the coupling port CPL, and the isolation port ISO of the directional coupler 20D are formed on the semi-insulating substrate 24 using a thin-film process. Note that the main line 21, the signal input port RFin, and the signal output port RFout are formed of Au or Al as an integral pattern so as to be electrically connected to one another. The sub line 22 and the isolation port ISO are also formed of Au or Al as an integral pattern so as to be electrically connected to each other. The coupling port CPL is formed of Au or Al as a pattern spaced apart from the sub line 22.

In the thin-film process, after an electrode material has been formed over the whole surface using evaporation, sputtering, plating, or the like, a resist layer is formed using a photolithography process or the like, and an unnecessary electrode material is removed by etching. Alternatively, after a resist layer pattern has been first formed using a photolithography process, an electrode material is deposited in portions other than the resist layer pattern using evaporation, sputtering, plating, or the like, and finally the resist layer is lifted off, whereby electrode patterns are formed. By using such a thin-film process, variations in the positions of the electrodes can be suppressed to 10 μm or less and, hence, variations in the electrical characteristics of the directional coupler can be made very small, whereby the yield of the directional coupler can be increased.

Note that when devices are manufactured using a thin-film process, silicon is generally used as a substrate material. However, when a silicon substrate, which is a semiconductor substrate and has a large loss, is used in the directional coupler of the present disclosure, insertion loss in the main line increases. On the other hand, by using the semi-insulating substrate 24, which is formed of a low-loss material such as GaAs, the insertion loss can be reduced.

Then, as illustrated in FIG. 10(C), the dielectric layer 23 is formed on the semi-insulating substrate 24 in such a manner that four openings are provided in the dielectric layer 23 for exposing the signal input port RFin, the signal output port RFout, the coupling port CPL, and the isolation port ISO. An etching process may be used to form the openings.

Then, as illustrated in FIG. 10(D), the top electrode 25 is formed on the surface of the dielectric layer 23 using a thin-film process. The top electrode 25 is formed as a pattern in such a manner as to extend from the opening where the coupling port CPL is exposed to the rectangular area of an end of the sub line 22. As a result, a region in which the top electrode 25 and the sub line 22 face each other can be made to function as the series capacitor Cx, whereby the isolation and directivity of the directional coupler 20D can be improved.

Figure 11:
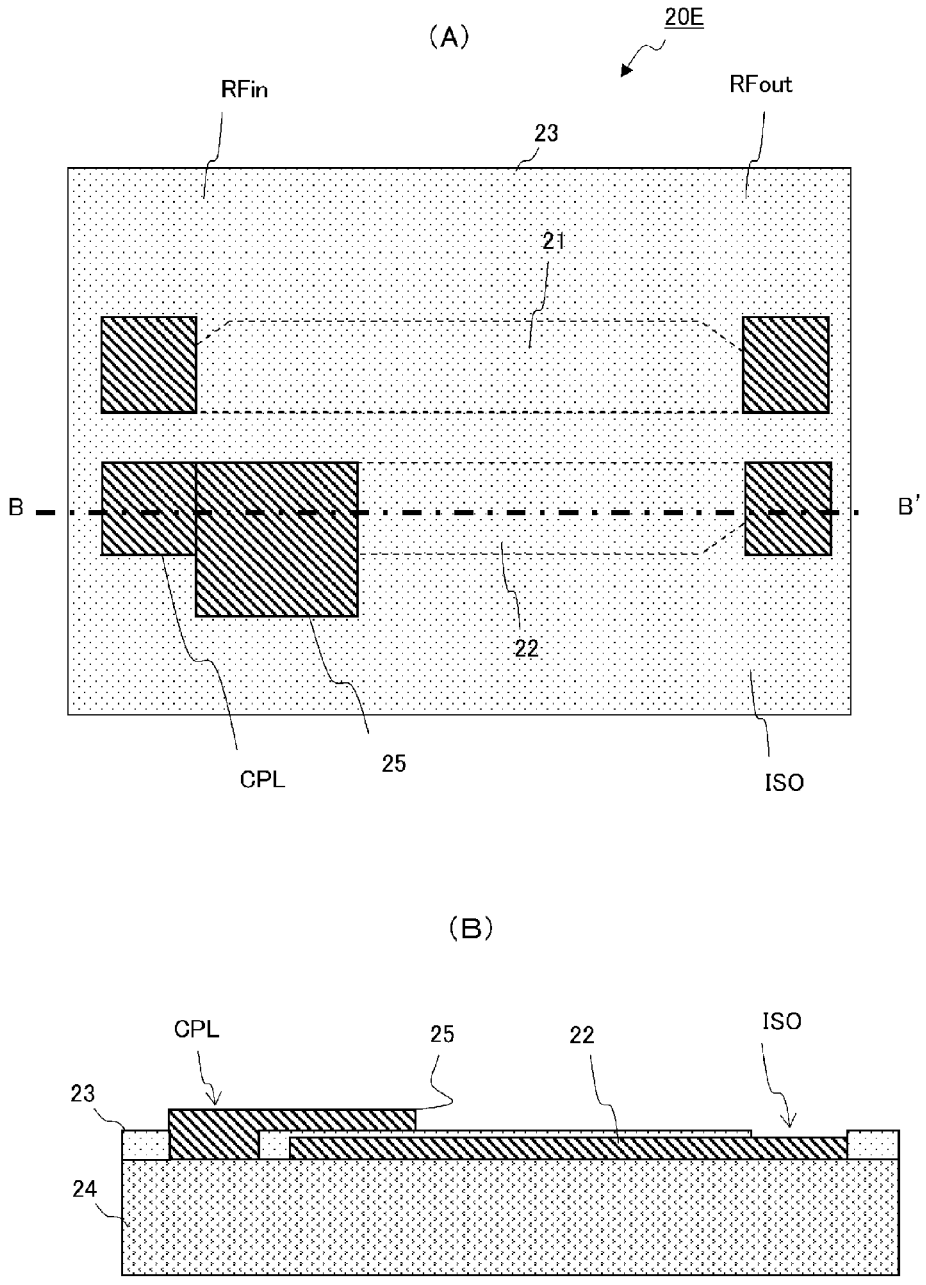
FIG. 11 is a diagram illustrating another example of a directional coupler.

Another example of the directional coupler of the present disclosure will now be described. FIG. 11(A) a pattern diagram of a directional coupler 20E, and FIG. 11(B) illustrates a sectional view taken along line B-B' illustrated in FIG. 11(A). In the sub line 22 and the top electrode 25 of the directional coupler 20E, the rectangular region functioning as the series capacitor Cx is enlarged so as to have a shape with a larger area than the surrounding portion. With this configuration, the capacitance of the series capacitor Cx can be made relatively large.

Figure 12:
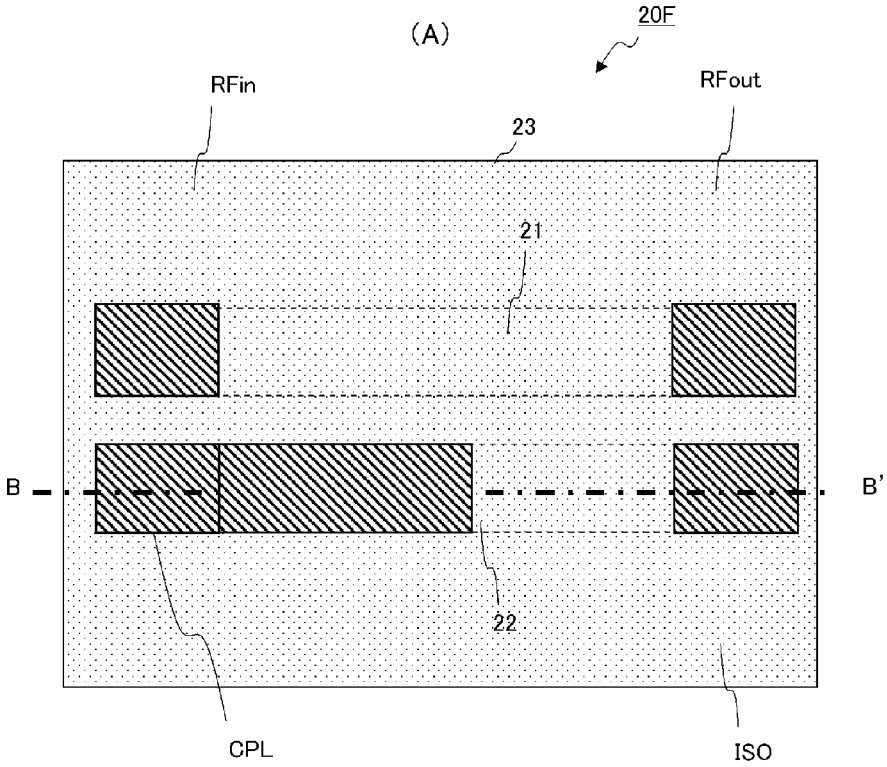
FIG. 12 is a diagram illustrating still another example of a directional coupler.
Figure 12:
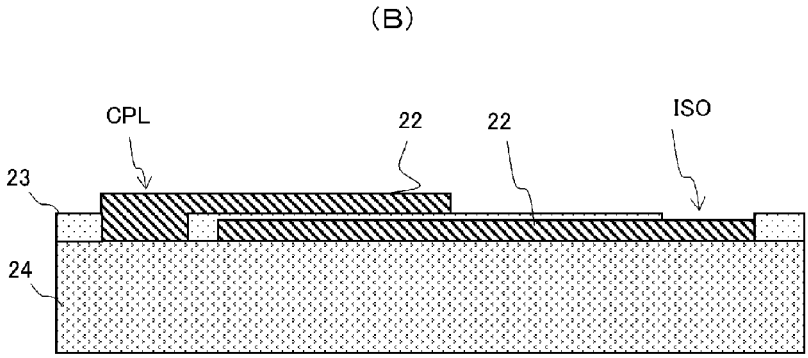

Still another example of the directional coupler of the present disclosure will now be described. FIG. 12(A) is a pattern diagram of a directional coupler 20F, and FIG. 12(B) illustrates a sectional view taken along line B-B' illustrated in FIG. 12(A). In the directional coupler 20F, to ensure that the series capacitor Cx has a relatively large capacitance, the top electrode 25 is shaped like a line which overlaps the sub line 22, while the shape of the sub line 22 is maintained as it is, whereby the rectangular region which functions as the series capacitor Cx is made to have a large area. With this configuration, the capacitance of the series capacitor Cx can be ensured without increasing the device size.

In an embodiment in which a directional coupler includes a main line and a sub line that is coupled to the main line through electric field coupling and magnetic field coupling, where the main line includes a signal input port and a signal output port, the sub line includes a coupling port and an isolation port, and a series capacitor is connected to only one of the signal output port and the coupling port, by connecting a series capacitor to only one of the signal output port and the coupling port, the isolation and directivity can be improved, and an increase in device size is suppressed compared with the case in which a series capacitor is connected to both of the signal output port and the coupling port.

In embodiments for which a capacitance C1 that resonates with a parasitic inductance of the signal output port at a desired frequency and for which a capacitance C2 that resonates with a parasitic inductance of the coupling port at the desired frequency, and a capacitance of the series capacitor is set smaller than or equal to the capacitance C1 or smaller than or equal to the capacitance C2, the isolation and directivity can be improved by inserting the series capacitor having the capacitance C1 or the capacitance C2, but improvement in the isolation and directivity increases as the capacitance becomes closer to the capacitance Cx, which is smaller than the capacitance C1 or the capacitance C2. Further, the smaller the capacitance, the smaller the size of the series capacitor, resulting in a reduction in device size.

In embodiments of a directional coupler where the main line, the sub line, and electrode patterns of the series capacitor are preferably formed using a thin-film process, variations in the positions of the components can be suppressed, whereby variations in the electric characteristics of the directional coupler can be limited to very small variations.

In embodiment of a directional coupler in which at least one of the main line and the sub line is preferably used as an electrode for composing the series capacitor, the electrode, the main line, and the sub line that compose the series capacitor can be produced together and, hence, the number of processes added to the existing manufacturing processes can be decreased. Further, the device size is prevented from being increased by the size of an area occupied by the electrode of the series capacitor.

Embodiments of a directional coupler that use a semi-insulating substrate result in a small loss and a reduction in the insertion loss of the directional coupler. In that case, reductions in device size and price can be realized by also mounting other active components together on the directional coupler.

In embodiments according to the present disclosure, even when parasitic inductance exists in the main line or sub line, good isolation characteristics and directivity can be obtained by inserting a series capacitor at only one of the signal output port and coupling port. In that case, an increase in the device size can be suppressed since only one series capacitor is used instead of two series capacitors.

As described above, exemplary embodiments and examples above in accordance with the present disclosure can be realized using various configurations and modifications, and the scope of the present disclosure is not limited to these embodiments and examples.

That which is claimed is:

1. A directional coupler comprising:

a main line including a signal input port and a signal output port; and a sub line that includes a coupling port and an isolation port and that is coupled to the main line through electric field coupling and magnetic field coupling, wherein a series capacitor is connected to only one of the signal output port and the coupling port, wherein the signal output port includes a first parasitic inductance and the coupling port includes a second parasitic inductance, and a capacitance value Cx of the series capacitor is determined as follows: for a capacitance value C1 that would cause resonance with the first parasitic inductance at a desired frequency and for a capacitance value C2 that would cause resonance with the second parasitic inductance at the desired frequency, the capacitance value Cx of the series capacitor is set smaller than or equal to the capacitance value C1 or smaller than or equal to the capacitance value C2.

2. The directional coupler according to claim 1, wherein for the capacitance value C1 that resonates with the parasitic inductance of the signal output port at the desired frequency and for the capacitance value C2 that resonates with the parasitic inductance of the coupling port at the desired frequency, the capacitance value Cx of the series capacitor is set to satisfy the following equation:

$$Cx=1/(1/C1+1/C2).$$

3. The directional coupler according to claim 1, wherein the series capacitor is connected to only the coupling port among the signal output port and the coupling port.

4. The directional coupler according to claim 2, wherein the series capacitor is connected to only the coupling port among the signal output port and the coupling port.

5. The directional coupler according to claim 1, wherein the main line, the sub line, and electrode patterns of the series capacitor are formed using a thin-film process.

6. The directional coupler according to claim 2, wherein the main line, the sub line, and electrode patterns of the series capacitor are formed using a thin-film process.

7. The directional coupler according to claim 1, wherein at least one of the main line and the sub line is used as an electrode for composing the series capacitor.

8. The directional coupler according to claim 2, wherein at least one of the main line and the sub line is used as an electrode for composing the series capacitor.

9. The directional coupler according to claim 1, further comprising a semi-insulating substrate on which the main line, the sub line, and electrodes for composing the series capacitor are formed.

10. The directional coupler according to claim 2, further comprising a semi-insulating substrate on which the main line, the sub line, and electrodes for composing the series capacitor are formed.

* * * * *